US007594598B2

(12) United States Patent
Chen et al.

(10) Patent No.: US 7,594,598 B2
(45) Date of Patent: Sep. 29, 2009

(54) SAFETY OF NAILING DEVICE

(75) Inventors: Ton-Yi Chen, Taichung (TW); Yuan-Shun Lee, Taichung (TW)

(73) Assignee: Jann Yei Industry Co., Ltd., Taichung (TW)

( * ) Notice: Subject to any disclaimer, the term of this patent is extended or adjusted under 35 U.S.C. 154(b) by 51 days.

(21) Appl. No.: 12/024,117

(22) Filed: Feb. 1, 2008

(65) Prior Publication Data

US 2009/0114696 A1 May 7, 2009

(30) Foreign Application Priority Data

Nov. 2, 2007 (TW) ..... 96141417 A

(51) Int. Cl.
*B27F 7/00* (2006.01)
*B25C 5/10* (2006.01)

(52) U.S. Cl. ..... 227/8; 227/10; 227/132; 227/110; 227/119

(58) Field of Classification Search ..... 227/8, 227/10, 132, 110, 119, 120, 121, 123
See application file for complete search history.

(56) References Cited

U.S. PATENT DOCUMENTS 2,285,512 A * 6/1942 Harley ..... 227/132
2,746,043 A * 5/1956 Zaller ..... 227/127
2,746,044 A * 5/1956 Cusumano et al. ..... 227/132
3,131,397 A * 5/1964 Miller ..... 227/132
3,229,882 A * 1/1966 Abrams ..... 227/132
3,780,417 A * 12/1973 Reynolds ..... 29/235
3,913,817 A * 10/1975 Barrett et al. ..... 227/126
3,948,426 A * 4/1976 La Pointe ..... 227/8
6,082,604 A * 7/2000 Dennis ..... 227/8
6,263,561 B1 * 7/2001 Sickels et al. ..... 29/798
6,908,021 B1 * 6/2005 Wang ..... 227/8
7,458,492 B2 * 12/2008 Terrell et al. ..... 227/8
7,464,843 B2 * 12/2008 Huang ..... 227/8
7,464,845 B2 * 12/2008 Chou ..... 227/132
7,484,647 B2 * 2/2009 Yang ..... 227/8
2002/0108996 A1 * 8/2002 Cornett et al. ..... 227/132
2008/0121678 A1 * 5/2008 Spasov et al. ..... 227/132

* cited by examiner

*Primary Examiner*—Brian D Nash
(74) *Attorney, Agent, or Firm*—Leong C. Lei

(57) ABSTRACT

A safety is incorporated in a nailing device, which ensures operation safety of the nailing device. The nailing device includes a housing in which a striker plate is mounted and movable to a ready-to-strike position for subsequently striking a nail out of the housing. The safety includes a retainer pivoted to the housing with an inner end engaging the striker plate to retain the striker plate against movement to the ready-to-strike position and an opposite outer end engaging a release plate that is biased by a spring to partially projecting beyond the housing. When the nailing device is properly set on a work piece, the release plate is forced against the biasing spring back into the housing and the inner end of the retainer is caused to disengage from and thus freeing the striker plate.

7 Claims, 7 Drawing Sheets

SAFETY OF NAILING DEVICE

BACKGROUND OF THE INVENTION (a) Technical Field of the Invention

The present invention relates to a safety for nailing devices, and in particular to a safety that, unless released, prevents the nailing device from operation by blocking a nail striker plate, in order to ensure operation safety of the nailing device.

(b) Description of the Prior Art

A nailing device functions to repeatedly and forcibly feed out nails for fixing different parts or articles together. A regular nailing device comprises a nail striker plate that is arranged inside a housing and movable up and down in a given direction. A strip of nails is accommodated in a bottom portion of the housing and is fed forward by a nail forwarding unit to locate below the striker plate for being struck out of the housing. The striker plate is movable either manually, electrically or pneumatically to a lifted, ready-to-strike position from which the striker plate is release to spontaneously strike out the nail located therebelow. Since the nailing device can be easily operated and provide efficient nailing operation, it has been widely used in for example carpentry.

A conventional nailing device is operated by lifting the striker plate to set the striker plate in a ready-to-strike condition. To avoid undesired operation of the nailing device, taking a manually operated nailing device as an example, a safety ring is provided on the housing of the nailing device to secure, in a releasable manner, an operating handle whereby mistakenly operating the handle to cause undesired percussion of nail can be eliminated. In use of the nailing device, the safety ring must be released to allow the nailing device to be set in a ready-to-strike condition, and therefore inadvertent percussion at the time that the nailing device is not properly set on a work piece may happen, which may hurt the operator or other persons standing nearby by shooting uncontrolled nail.

To cope with such a problem, Taiwan Patent No. 1281432 discloses a nailing device comprising a housing in which a safety bar is movably arranged in such a way that the safety bar is normally projecting out of a bottom of the housing. The safety bar functions to prevent an engaging portion formed on a handle from engaging an opening defined in a striker plate. When the nailing device is properly set on a work piece, the safety bar is forced into the housing, allowing the handle to engage the striker plate for setting the nailing device in a ready-to-strike condition. As such, inadvertent percussion of the nailing device can be avoided.

The known device uses a biasing torque provided by a torsion spring to disengage the engaging portion of the handle from the opening of the striker plate in order to realize prevention of inadvertent percussion. However, when the operator of the nailing device applies a force that exceeds the spring force, the engaging portion of the handle may also get back into engagement with the opening of the striker plate to cause undesired percussion. Apparently, the known device is not capable to fully eliminate the potential risk of inadvertent percussion.

Since the force that strikes the nail out of the housing of the nailing device is very significant, if the nail is undesirably shot to a human body, damage may be resulted. This is even worse if the nail shoots at the eyes, which may lead to loss of sight. Thus, it is important that inadvertent percussion of the nailing device can be definitely excluded unless the nailing device is properly set on a work piece to thereby ensure operation safety of the nailing device.

In view of the above discussion, the present inventor has engaged in researches in the related fields, attempting to ensure an improvement that secures the operation safety of a nailing device by incorporating a novel safety to eventually and completely overcome the problem associated with inadvertent percussion of the conventional nailing devices.

SUMMARY OF THE INVENTION

The primary purpose of the present invention is to provide a safety for a nailing device that eliminates inadvertent percussion of the nailing device to secure the operation safety of the nailing device.

The objective can be realized with the following construction of nailing device, which comprises a housing, a striker plate that is slidably arranged in a front end portion of the housing, a spring plate that applies a strong driving force to the striker plate set in a ready-to-strike position to make the striker plate performing downward striking, and a handle that selectively drives the striker plate to the ready-to-strike position. In accordance with the present invention, a safety is provided, accommodated in the housing in front of the striker plate.

The safety comprises a release plate, a retainer, and a recoiling spring. The release plate is movably mounted in the housing and is movable in a direction similar to a moving direction of the striker plate. The release plate is arranged to be normally and partially projecting beyond a bottom of the housing but is not allowed to separate from the housing. The retainer is rotatably mounted to the housing and has first and second end portions respectively corresponding to and engaging the release plate and the striker plate. The recoiling spring is arranged above the first end portion of the retainer to bias the release plate to normally project beyond the bottom of the housing with the second end portion of the retainer retaining the striker plate against movement to the ready-to-strike position. When the release plate is caused to move against the recoiling spring to get back into the housing, for example by being positioned on a work piece, the retainer is rotated to have the second end portion thereof moved in such a manner to disengage from the striker plate thereby releasing the striker plate from being retained against upward movement to the ready-to-strike position.

With such an arrangement, the safety of the present invention comprises a retainer that effectively prevents the striker plate to be moved to the ready-to-strike position until the release plate is forced back into the housing. Thus, unless the nailing device is properly set on the surface of a work piece, which forces the release plate back into the housing of the nailing device, the striker plate cannot be moved to the ready-to-strike position. In this way, operation safety of the nailing device during regular uses can be secured.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
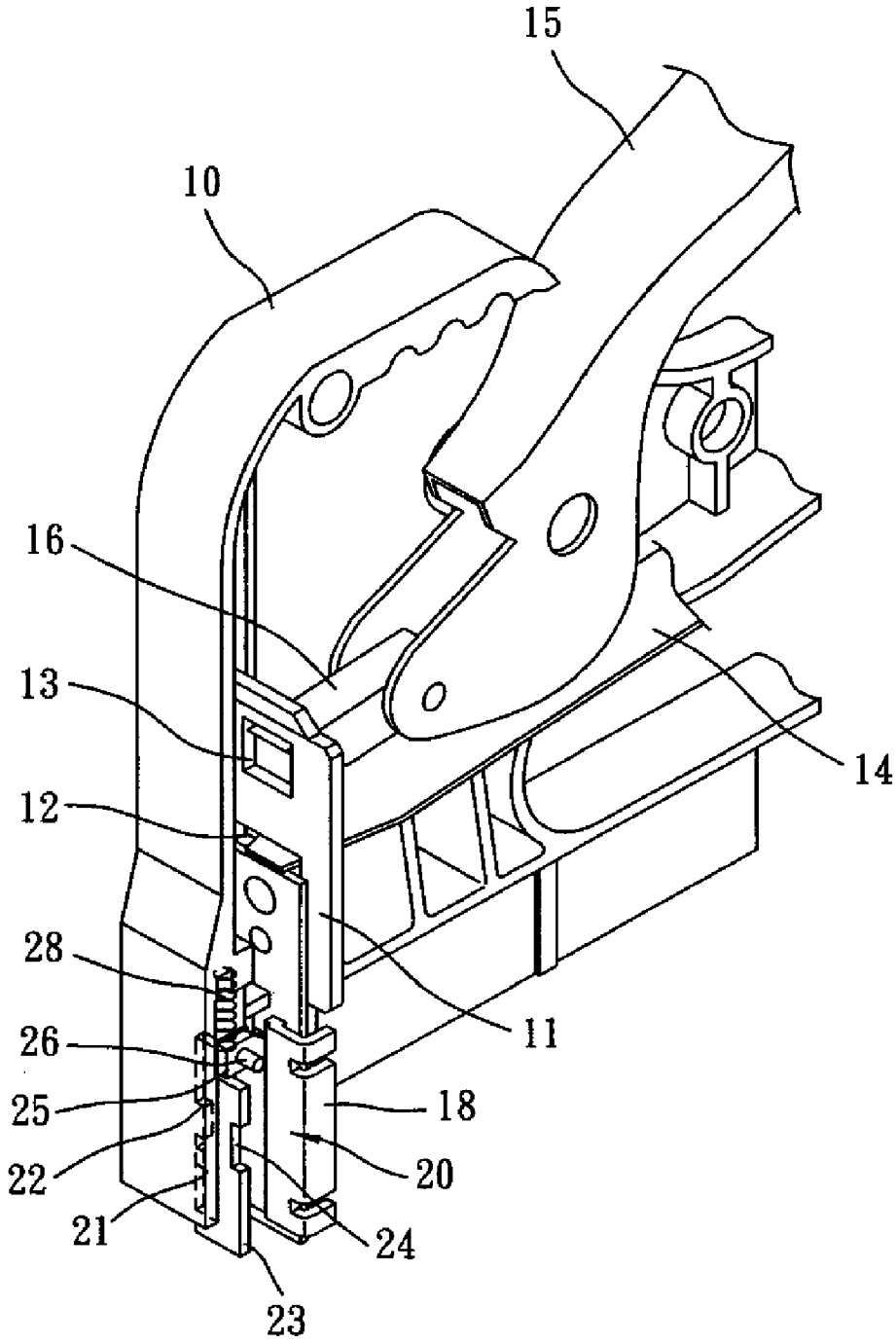
FIG. 1 is a perspective view of a portion of a nailing device of which a housing is broken to illustrate a safety constructed in accordance with the present invention.
Figure 2:
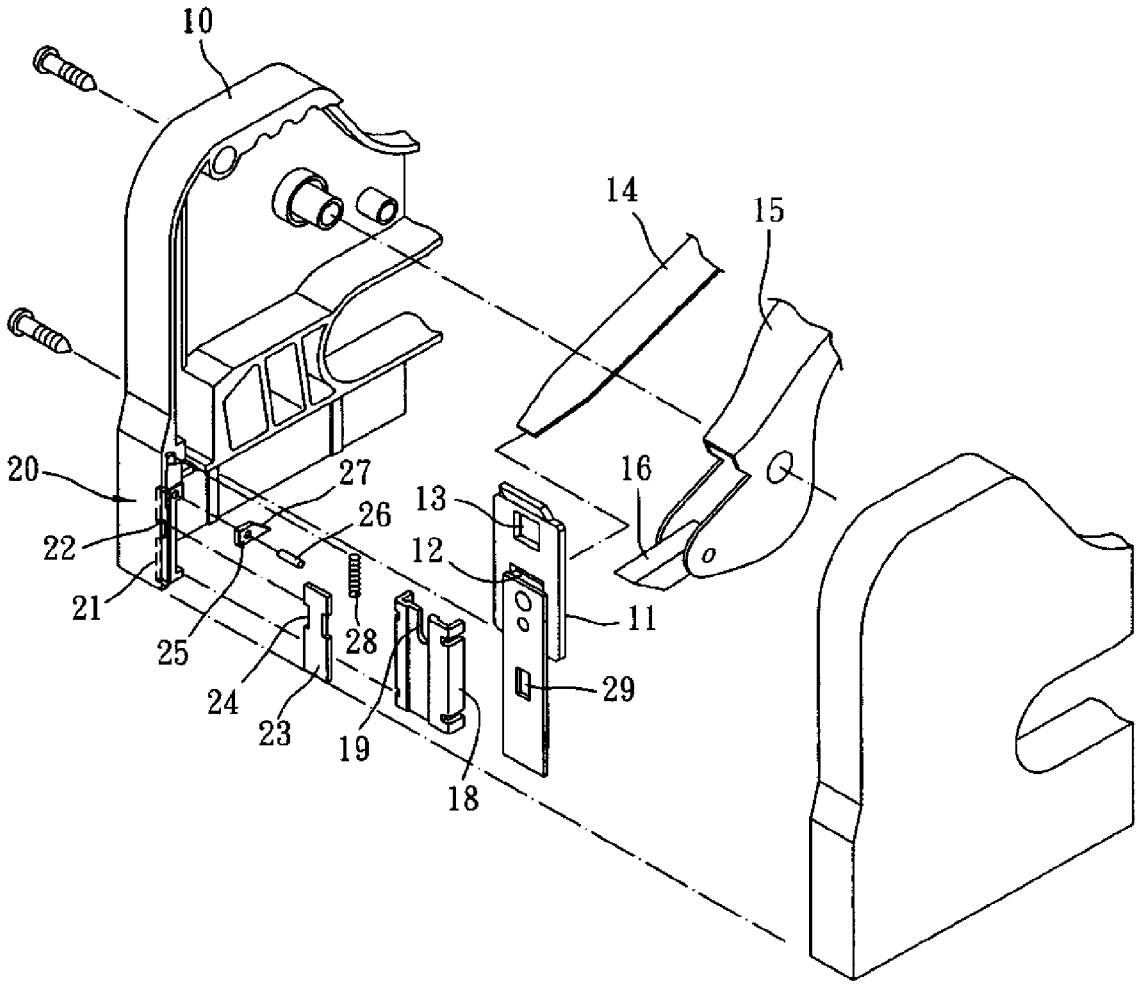
FIG. 2 is an exploded view of the portion of the nailing device in accordance with the present invention, illustrating the spatial relationship among the parts thereof.

With reference to the drawings, and in particular to FIGS. 1 and 2, a safety is provided for preventing a nailing device from being accidentally triggered to shoot a nail in an unexpected manner. As shown in the drawings, the nailing device in which the safety in accordance with the present invention is embodied comprises a housing 10, a nail striker plate 11 arranged in a front end portion of the housing 10, a spring plate 14 that provides a sufficient biasing force to the striker plate 11, and a handle 15 for manually lifting the striker plate 11 against the spring plate 14. The striker plate 11 is accommodated in the front end portion of the housing 10 in a slidable manner and serves to strike out nails 30 that are lined up under the striker plate 11, see FIG. 3. The striker plate 11 forms a spring hole 12 for receiving a front tip of the spring plate 14 and a driving hole 13 that is operatively coupled to the handle 15. The handle 15 is provided, at a front end thereof, with a driving member 16 that engages the driving hole 13 of the striker plate 11. The handle 15 is preferably constructed for manual operation to drive the striker plate 11 to the lifted position and, in the following description, an example of manually operable handle 15 will be given for explanation of the present invention. The safety constructed in accordance with the present invention, which is generally designated with reference numeral 20, is arranged in the front end portion of the housing 10 to be in front of the striker plate 11 to prevent undesired percussion of the striker plate 11 at the time when the nailing device is not properly positioned against a work piece.

In the following description, a preferred embodiment of the safety 20 constructed in accordance with the present invention will be illustrated with reference to FIGS. 1-3. The housing 10 comprises a rail 18 for guiding movement of the striker plate 11 in upward and downward directions. In the embodiment illustrated, the rail 18 is in the form of a plate having opposite lateral edges bent to form opposing channels for slidably receiving opposite edges of the striker plate 11; however, it is apparent that the rail 18 can be embodied in different form, while maintaining the same function as will be described herein. The rail 18 has a top edge in which a notch 19 is defined. The safety 20 comprises a release plate 23, a retainer 24, and a recoiling spring 28. The release plate 23 is slidably received in a chute 21 defined in the housing 10 so as to be movable in the same direction as the striker plate 11. The chute 21 has opposite banks corresponding opposite edges of the release plate 23 and each bank and the associated edge of the release plate 23 form engageable fixing means 22, 24. The fixing means 22, 24 engage each other in such a way to enable limited relative movement of the release plate 23 with respect to the housing 10 without separation. Also, the engagement between the fixing means 22, 24 serves to prevent the striker plate 11 from being undesirably lifted. This will be further discussed. In the embodiment illustrated, the fixing means 22, 24 are, respectively, a pawl and a corresponding notch that is extended in the movement direction of the release plate 23 to a desired length for movably receiving the pawl therein to establish the engagement therebetween. The engagement of the pawl 22 and the notch 24 is such that a lower end portion is normally projecting beyond a bottom of the housing 10 to a desired length. The retainer 25 is pivotally mounted in the housing 10 by a pivot 26 and located above the release plate 23 and substantially corresponding to a constraint hole 29 defined in the striker plate 11 whereby end sections of the retainer 25 that are located on opposite sides of the pivot 26 are respectively corresponding to the release plate 23 and the constraint hole 29 of the striker plate 11. The shape of constraint hole 29 of the striker plate 11 and the spatial relationship among the retainer 25, the release plate 23 and the constraint hole 29 are such that the retainer 25 is allowed to rotate in a predetermined direction to have the end portion of the retainer 25 corresponding to the constraint hole 29 (which will be referred to the constraint-hole-side end portion) moved downward, but not in the reversed direction to move the constraint-hole-side end portion upward. In the embodiment illustrated, the constraint hole 29 is shaped and sized to allow the constraint-hole-side end portion of the retainer 25 to be partially and movably received therein. The constraint-hole-side end portion of the retainer 25 is provided with an inclined face 27, which functions to eliminate the interference of the retainer 25 with the downward striking movement of the striker plate 11. The recoiling spring 28 is arranged above the end portion of the retainer 25 that is opposite to the constraint-hole-side end portion to bias the retainer 25 in such a way that the constraint-hole-side end portion of the retainer 25 is normally received in the constraint hole 29 of the striker plate 11 to limit the upward movement of the striker plate 11 thereby preventing the striker plate 11 from being lifted.

With such an arrangement, when the nailing device is not set in a normal operation condition where the nailing device is positioned against for example a work piece, the striker plate 11 cannot be lifted by operation of the handle 15 for percussion. Thus, accidental or undesired triggering to shoot nails can be prevented and accordingly, a safety for a nailing device is realized.

Figure 3:
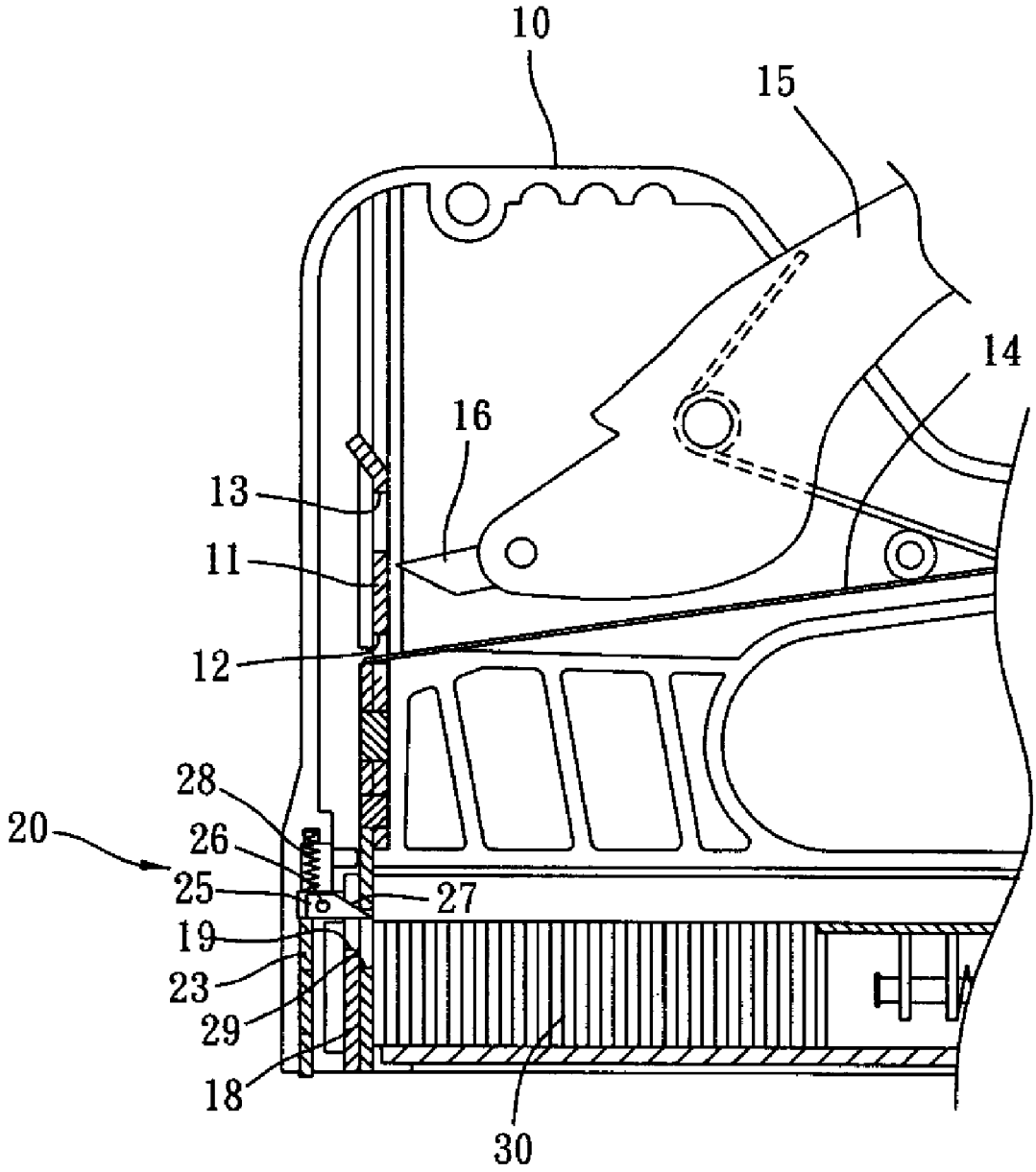
FIG. 3 is a cross-sectional view of the nailing device incorporating the safety of the present invention.
Figure 4:
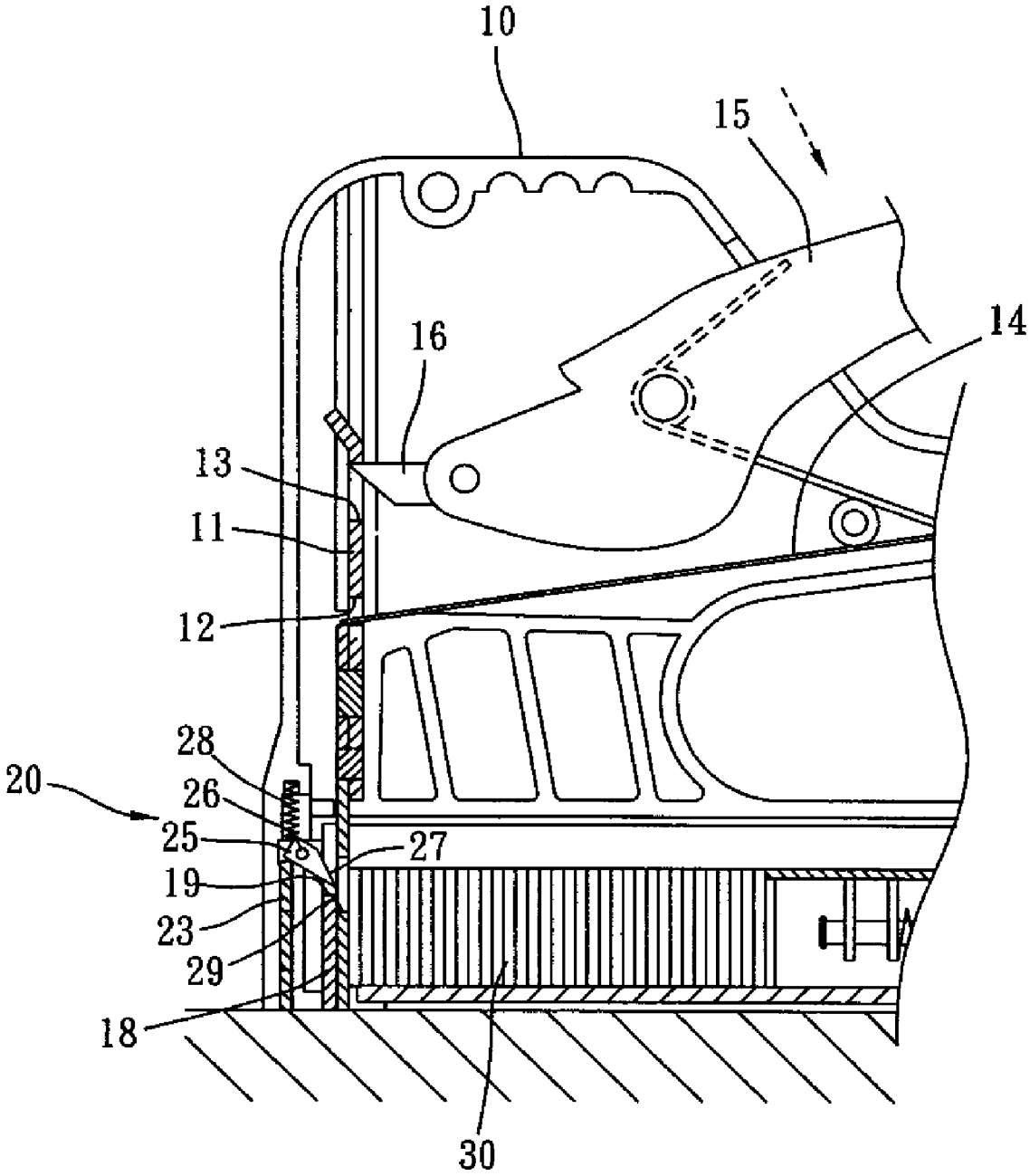
FIG. 4 is a cross-sectional illustrating the nailing device is properly set on a work piece to start the nailing operation.
Figure 5:
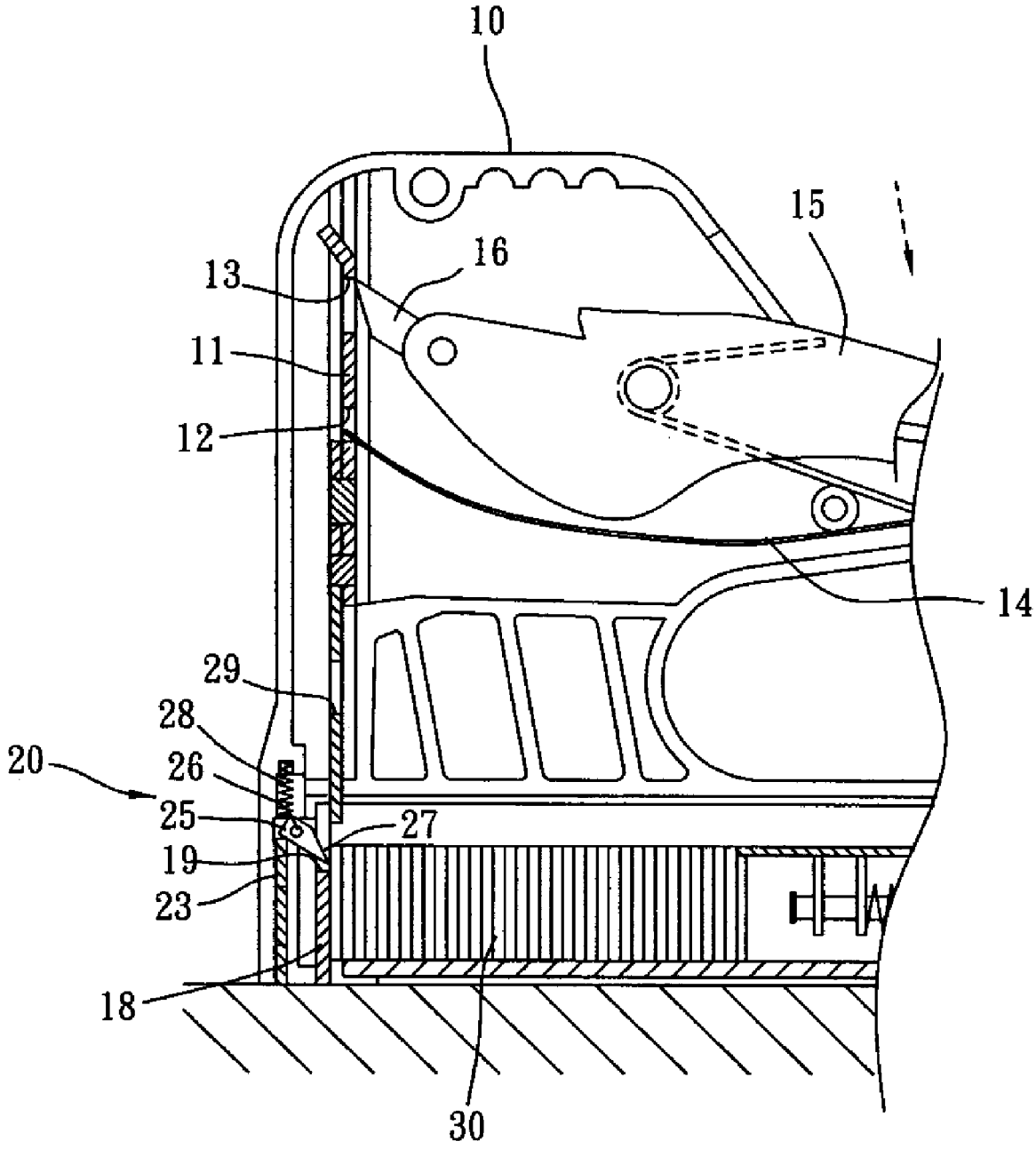
FIG. 5 is similar to FIG. 4 but illustrating when a handle is operated to cause a striker plate to move toward a lifted, ready-to-strike position.
Figure 6:
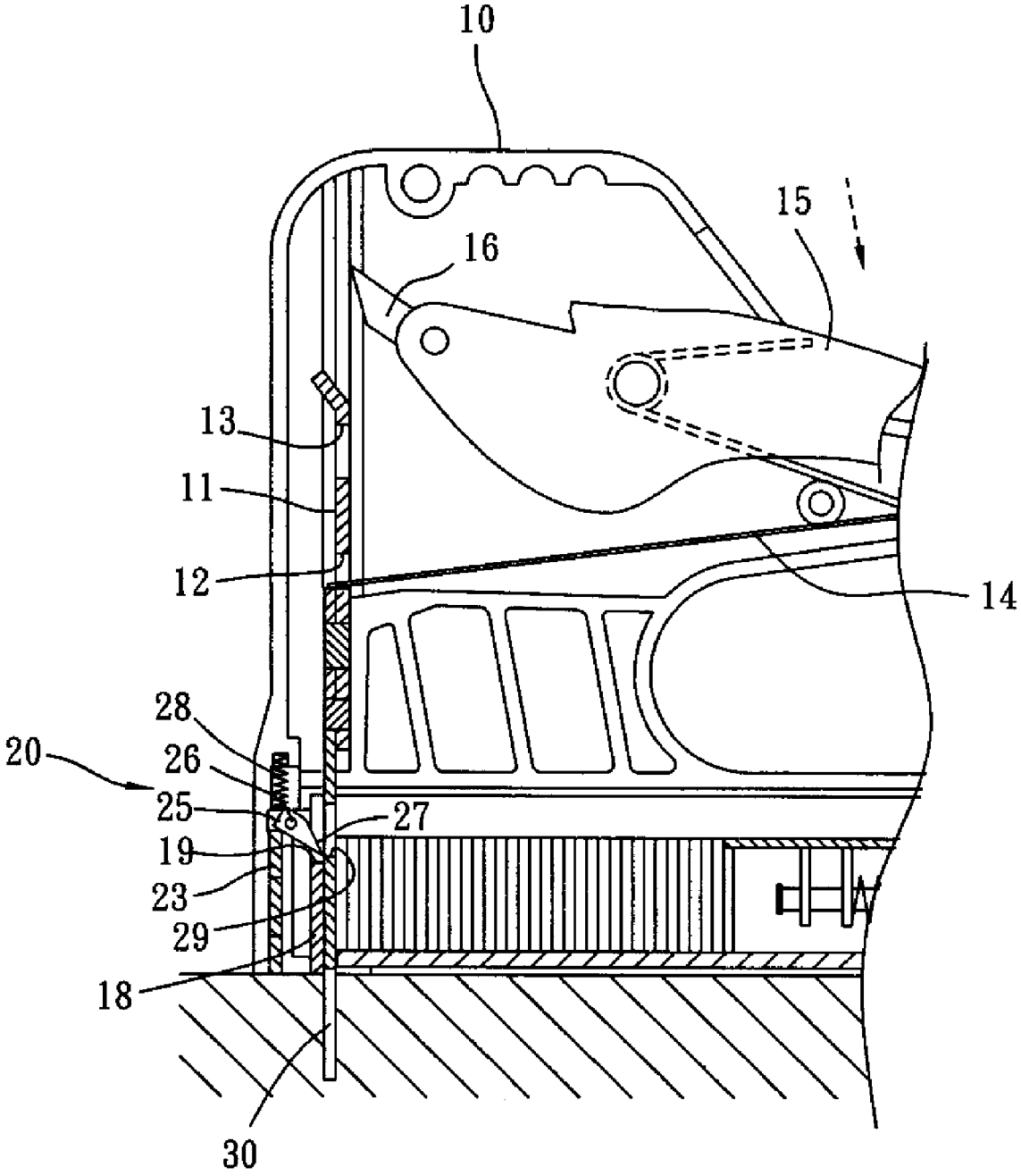
FIG. 6 is similar to FIGS. 4 and 5, and illustrating the striker plate is forcibly driven downward by a spring plate to strike a nail into the work piece.

For practical operation of the nailing device of the present invention, as shown in FIGS. 3-6, when a nailing operation is desired, an operator positions the nailing device against a surface of a work piece on which the nailing operation is to be carried out. By doing so, the surface of the work piece forces the release plate 23 of the safety 20 into the housing 10 and causes the release plate 23 to move upward. The upward movement of the release plate 23 drives the end portion of the retainer 25 corresponding to the release plate 23 to simultaneously move upward, leading to rotation of the retainer 25 about the pivot 26 and compression of the recoiling spring 28 located above the retainer 25 to enable storage of potential energy therein. As a result of the rotation of the retainer 25, the constraint-hole-side end portion of the retainer 25 disengages from the constraint hole 29 thereby opening the safety 20, as shown in FIG. 4. The operator may then actuate the handle 15 and the driving member 16 of the handle 15, which engages the driving hole 13 of the striker plate 11, drives the striker plate 11 toward the lifted, ready-to-strike position. Meanwhile, the spring plate 14 is deflected upward, as shown in FIG. 5, and a recoiling force is established. Once the striker plate 11 is sufficiently moved upward to the lifted position, the driving member 16 of the handle 15 is allowed to disengage from the driving hole 13 of the striker plate 11 and the striker plate 11 is released so that the striker plate 11, under the action of the recoiling force provided by the spring plate 14, is strongly and forcibly driven downward to strike the nail 30 located therebelow into the work piece, as shown in FIG. 6. This completes the nailing operation. After that, the striker plate 11, the release plate 23 and the retainer 25 are all returned to their original positions to get ready for next nailing operation.

Figure 7:
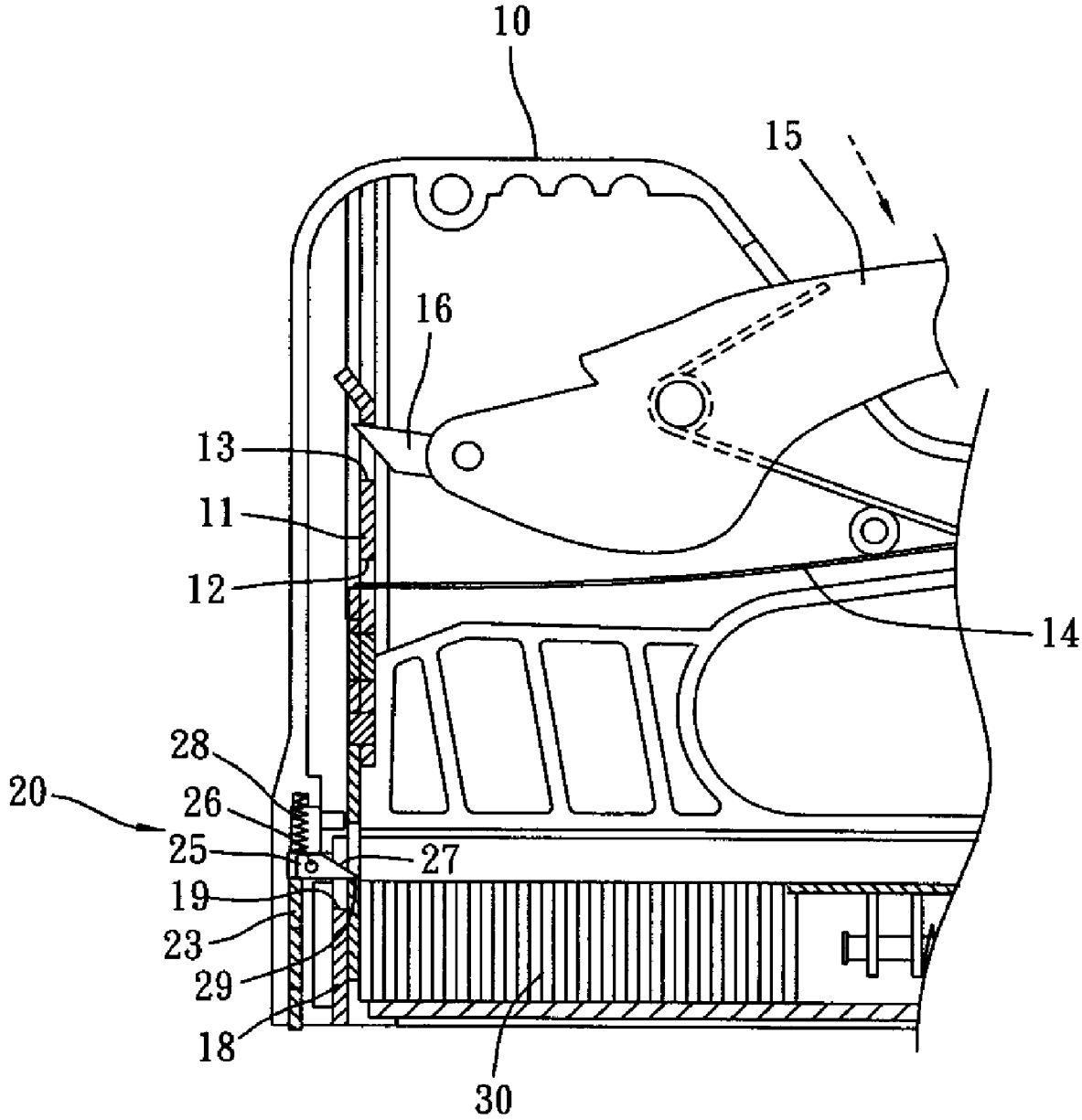
FIG. 7 is a cross-sectional illustrating the nailing device in a condition when the safety is not released.

On the other hand, if the nailing device is not properly positioned against the surface of the work piece, then as shown in FIGS. 3 and 7, the retainer 25 of the safety 20 is subjected to the biasing force of the recoiling spring 28 to maintain the release plate 23 in the condition of downward projecting beyond the housing 10 and the constraint-hole-side end portion of the retainers 25 is set in the constraint hole 29. Thus, when the operator attempts to operate the handle 15 for causing the driving member 16, which engages the driving hole 13 of the striker plate 11, to drive the strike plate 11 upward, the constraint hole 29 of the striker plate 11 engages the retainer 25 (or more precisely, as illustrated in the drawings, a bottom wall of the constraint hole 29 abuts a bottom face of the constraint-hole-side end portion of the retainer 25) and the retainer 25 is blocked by the release plate 23, which is in turn fixed with respect to the chute 21 by the fixing means 22, 24 in the upward direction, whereby the striker plate 11 is prevented from moving upward by the operator's attempt. Thus, a secured condition of the safety 20 is ensured. And, consequently and as shown in FIG. 7, the striker plate 11 cannot be moved upward to the lifted, ready-to-strike position. In this way, undesired movement of the striker plate 11 up to the lifted, ready-to-strike position is prevented and the nailing device cannot shoot nails in a condition where the nailing device is not properly set on a surface of a work piece. Undesired and accidental percussion of the nailing device is thus eliminated.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A safety adapted to be incorporated in a nailing device that comprises a housing containing therein a nail, a striker plate that is mounted in the housing and movable to a ready-to-strike position from which the striker plate is selectively released to strike a nail out of the housing, a spring plate that applies a spring force to cause the striker plate to move from the ready-to-strike position to strike the nail, and a handle for moving the striker plate to a ready-to-strike position, the safety being arranged in a location corresponding to the striker plate, and the safety comprising a release plate, a retainer, and a recoiling spring, wherein the release plate is movably mounted in the housing and movable in a direction similar to a moving direction of the striker plate, the release plate being arranged to be normally and partially projecting beyond a bottom of the housing in a non-detachable manner, the retainer being rotatably mounted to the housing and having first and second end portions respectively corresponding to and engaging the release plate and the striker plate, the recoiling spring being arranged above the first end portion of the retainer to bias the release plate to normally project beyond the bottom of the housing with the second end portion of the retainer retaining the striker plate against movement to the ready-to-strike position;

wherein when the release plate is caused to move against the recoiling spring to get back into the housing, the retainer is rotated to have the second end portion thereof moved in such a manner to disengage from the striker plate thereby releasing the striker plate from being retained against upward movement to the ready-to-strike position.

2. The safety as claimed in claim 1, wherein the housing forms a chute receiving and guiding the movement of the release plate and wherein fixing means is formed between the chute and the release plate to provide limited movement to the release plate so that the release plate is partially projecting beyond the housing but is not allowed to detached from the housing.

3. The safety as claimed in claim 2, wherein the fixing means comprises at least one pawl and a corresponding notch that receives and engages the pawl, the notch being elongated to allow the limited movement of the release plate with respect to the chute for partially projecting beyond the housing.

4. The safety as claimed in claim 1, wherein the retainer is mounted to the housing by a pivot so as to be rotatable with respect to the housing.

5. The safety as claim in claim 1, wherein the striker plate forms a constraint hole corresponding to the second end portion of the retainer, whereby when the release plate projects beyond the housing, the second end portion of the release plate is received in and engages the constraint hole to set a constraint for retaining the striker plate against movement toward the ready-to-strike position and when the release plate is moved back into the housing, the second end portion of the retainer disengages from the constraint hole to remove the constraint of the striker plate.

6. The safety as claimed in claim 5, wherein the second end portion of the retainer forms an inclined face to eliminate interference of the retainer with the movement of the striker plate from the ready-to-strike position to strike the nail.

7. The safety as claimed in claim 1, wherein the second end portion of the retainer forms an inclined face to eliminate interference of the retainer with the movement of the striker plate from the ready-to-strike position to strike the nail.

* * * * *